United States Patent [19]

King

[11] 4,321,433

[45] Mar. 23, 1982

[54] WATERPROOF HELMET ENCASING ELECTRONIC COMPONENTS

[76] Inventor: Frederick T. King, 324 16th St., #F, Huntington Beach, Calif. 92648

[21] Appl. No.: 119,998

[22] Filed: Feb. 8, 1980

[51] Int. Cl.[3] ..... A42B 3/00; H04R 1/02

[52] U.S. Cl. ..... 179/156 R; 2/414; 179/184; 455/351

[58] Field of Search ..... 179/156 R, 156 A, 1 UW, 179/184, 182 R, 182 A; 455/351, 100, 90, 89, 344; 2/414, 410, 6, 2

[56] References Cited

U.S. PATENT DOCUMENTS

| | | | |
|---|---|---|---|
| 1,235,851 | 8/1917 | Spence | 179/156 R |
| 2,497,336 | 2/1950 | Young | 179/107 R |
| 3,162,813 | 12/1964 | Piccinini | 455/351 X |
| 3,218,607 | 11/1965 | Brock et al. | 455/89 X |
| 3,806,951 | 4/1974 | Halteman | 2/6 |
| 4,012,794 | 3/1977 | Nomiyama | 2/6 X |
| 4,227,520 | 10/1980 | Lord | 2/6 X |

FOREIGN PATENT DOCUMENTS

| | | | |
|---|---|---|---|
| 815547 | 6/1959 | United Kingdom | 179/156 R |
| 945412 | 12/1963 | United Kingdom | 2/414 |

OTHER PUBLICATIONS

"Introducing Hatcom", 8-page brochure, 1979, Sound and Alarm Systems, Inc (ITT).

*Primary Examiner*—Thomas W. Brown
*Attorney, Agent, or Firm*—Roger A. Marrs

[57] ABSTRACT

A helmet is disclosed herein having a three-piece construction comprising a liner of soft, resilient material adapted to reside adjacent the head of the user, an intermediate shell which lies over the inner layer and which mounts component parts constituting a radio, transmitter or the like, and a protective outer shell which covers the electrical components. The outer shell and the intermediate shell are joined in snap-lock relationship to provide a waterproof seal to protect the electronic component parts. Rigidity and impact support is obtained by means of transverse ribs separating the opposing surfaces of the intermediate and outer shell so that the electronic components are protected thereby. A detachable visor is provided as well as a chin strap for retaining the interlocked shells on the wearer's head. The chin strap includes earphones operably connectible to the electronic components so that the wearer may enjoy listening to the radio while engaging in water sports. Various controls for the radio are provided through the helmet and are sealed to prevent entry of water into the electronic component compartment.

4 Claims, 7 Drawing Figures

FIG. 2
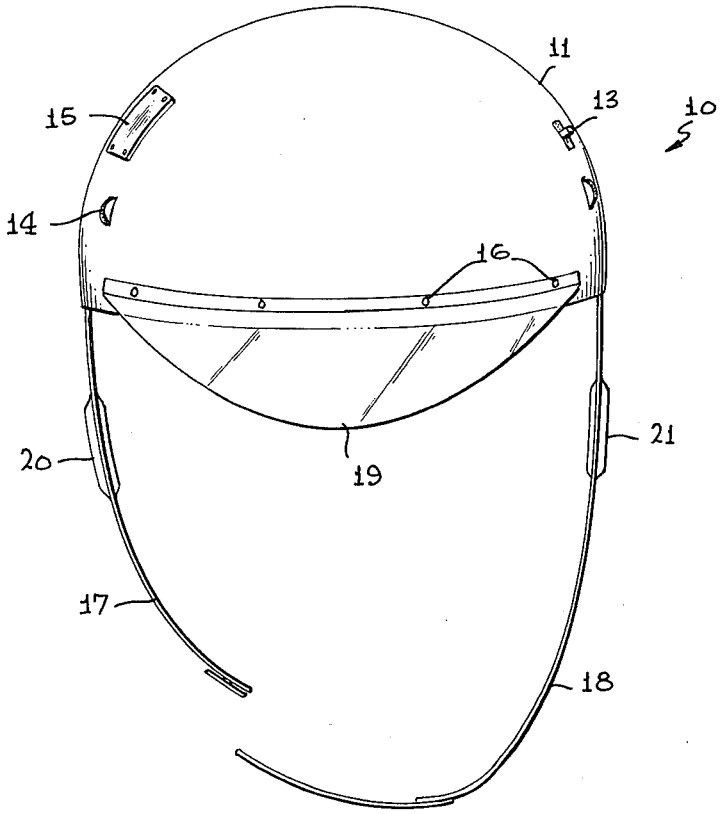
FIG. 3
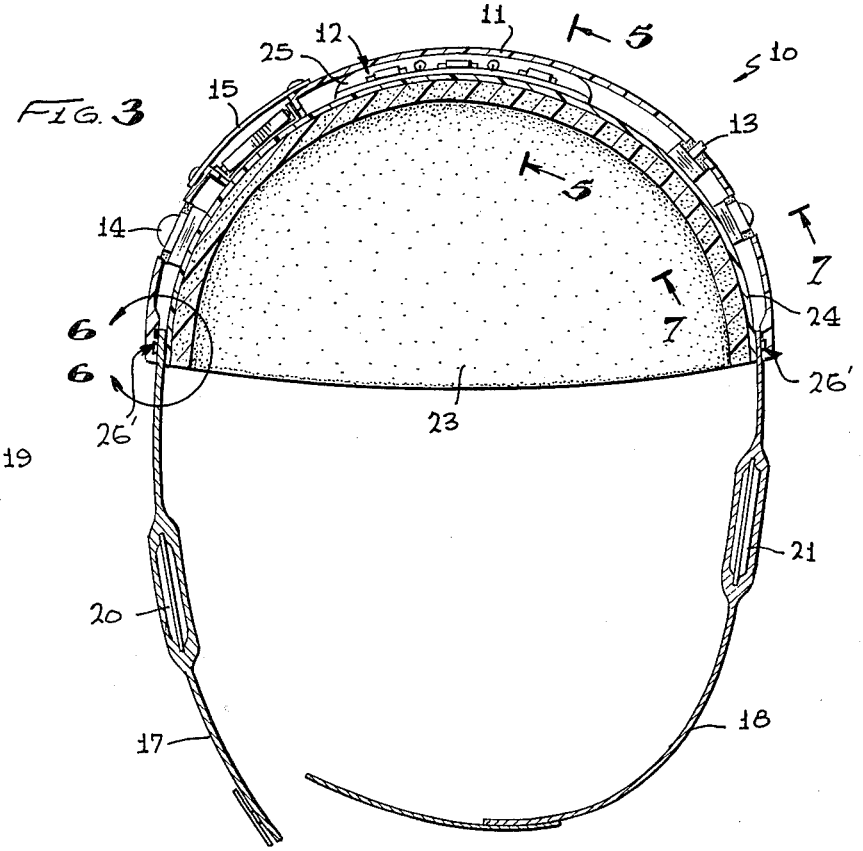
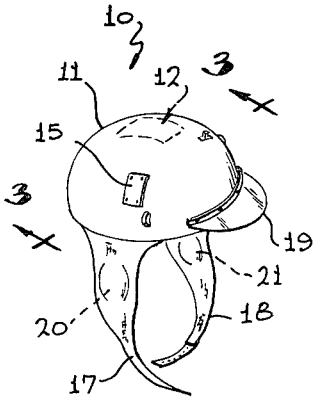
FIG. 1

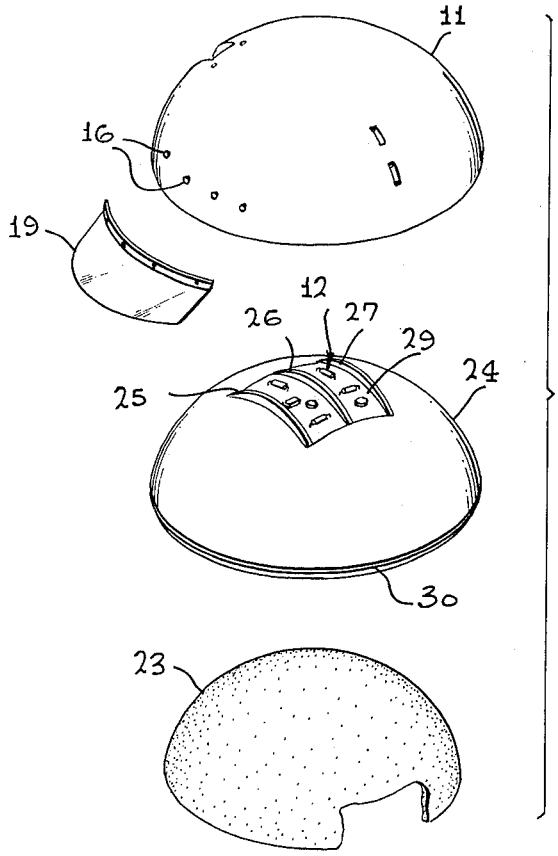
FIG. 4
FIG. 5
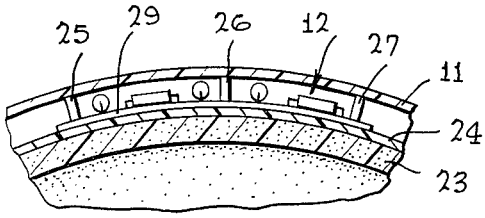
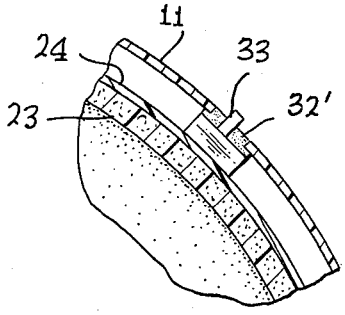
FIG. 7
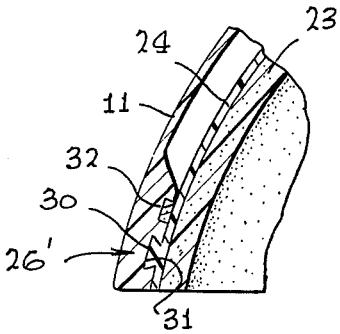
FIG. 6

WATERPROOF HELMET ENCASING ELECTRONIC COMPONENTS

BACKGROUND OF THE INVENTION

1. Field of the Invention

This invention relates to protective helmets and more particularly to a novel protective helmet including electronic components for operating a radio, transmitter or the like and which is waterproof so that the helmet may be worn by persons engaging in a water sport.

2. Brief Description of the Prior Art

Protective helmets have been provided for persons engaging in sports which serve to protect the wearer from injury to the head. In some instances, electronic components such as radios have been carried on the helmet so that the persons may enjoy listening to music or other programs while engaging in a particular sport.

However, problems and difficulties have been encountered when employing protective helmets of the conventional type which stem largely from the fact that the helmets cannot be worn in a wet or damp environment such as when engaged in the sport of surfing, canoeing or swimming. Under such conditions, the water sometimes comes in contact with the sensitive electronic components causing the electronic or electrical device to fail operationally. Also, such helmets for engagement in the sports seldom requires more than partial protection of the wearers head. For example, motorcycle helmets entirely encompass the entire head and part of the users neck. For water sports, such enclosure is not only unnecessary but highly undesirable.

Therefore, a long standing need has existed to provide a protective helmet which may readily carry a radio or other electrical device so that the device may be operated while the person wearing the protective helmet is engaging in a particular water sport. The device should adequately waterproof the electrical equipment so as to prevent operational failure.

SUMMARY OF THE INVENTION

Accordingly, the above problems and difficulties are obviated by the present invention which provides a novel protective helmet having radio devices provided thereon in a waterproof manner whereby a substantially exposed portion of a persons head is protected while engaging in a water sport. The protective helmet comprises a three-piece construction including an inner liner of resilient material which is nested inside of an intermediate hard shell that is snap locked to an outer shell. The inner shell includes a plurality of transverse ribs separating the opposing surfaces of the intermediate shell with the outer shell so that a cavity or chamber is defined occupied by electrical components of a radio or the like. The snap-lock device is of a waterproof nature and the controls for the radio are exposed through apertures in the outer shell in a waterproof or watertight manner. Chin strap devices are carried on opposite sides of the outer shell and downwardly depend therefrom so that ready attachment may be made under the chin of the wearer to releasably secure the helmet on this head. The chin strap devices include loudspeakers operably connected to the electrical components of the radio. A detachable visor is releasably connected to the front of the outer shell.

Therefore, it is among the primary objects of the present invention to provide a novel protective helmet which is useful in water sports.

Another object of the present invention is to provide a novel waterproof protective helmet enclosing electrical components of a radio device so that the wearer may enjoy music or other radio programming while engaging in a water sport.

Still another object of the present invention is to provide a novel protective helmet for a person engaging in a water sport which is waterproof and which encloses a radio or other electrical device so that the wearer may listen to the programming while engaging in the water sport.

Still a further object of the present invention is to provide a protective helmet having three detachable and interconnecting layers or shells which may be worn as a unit or seperately wherein the engagement of at least two of the elements provides a waterproof compartment therebetween.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is an elevated side view of the novel protective helmet of the present invention;

FIG. 2 is a fragmentary sectional view showing the protective helmet of FIG. 1;

FIG. 3 is a transverse cross-sectionsl view of the protective helmet shown in FIG. 1 as taken in the direction of arrows 3—3 thereof;

FIG. 4 is an exploded view of the protective helmet showing the major components thereof;

FIG. 5 is a fragmentary cross-sectional view taken in the direction of arrows 5—5 of FIG. 3;

FIG. 6 is a fragmentary sectional view as taken between the arrows 6—6 shown in FIG. 3; and FIG. 7 is a cross-sectional view taken in the direction of arrows 7—7 of FIG. 3.

DESCRIPTION OF PREFERRED EMBODIMENT

Referring to FIG. 1, the novel protective helmet of the present invention is illustrated in the general direction of arrow 10 and it can be seen that the helmet includes an outer shell 11 which encloses and covers a plurality of electronic components illustrated in general by the numeral 12. New electronic components are underneath the shell 11 and are connected to operating controls 13 and 14 in a conventional manner. Power for the electronic components is provided by a battery which is removeably mounted under a cover plate 15. The helmet 10 further includes a detachable visor 19 carried on the front of the outer shell 11 on a plurality of snaps or buttons 16 (see FIG. 2). Also, the outer shell 11 carries chin strap devices comprising flaps 17 and 18 which downwardly depend from opposite sides of the outer shell 11. Any kind of attachment means may be provided for coupling the straps together such as a velcro fastener, a buckle or the like. The flaps 17 and 18 further include loudspeaker devices such as earphones 20 and 21 so that the wearer of the protective helmet may hear the sounds produced by the electronic device 12 while the wearer is engaged in a water sport.

Referring now in detail to FIG. 2, it can be seen that the visor 19 is carried on the front of the outer shell 11 and that it is equal distance between the flaps 17 and 18 of the chin strap devices. Also, it can be seen that the controls for the radio or other electronic device are exposed through the external surface of the outer shell 11 so that the controls are within finger reach of the user. When it is time to change the battery for the electronic device, cover 15 is removed and a battery exchanged for a fresh one.

Referring now in detail to FIG. 3, it can be seen that the protective helmet 10 further includes an inner liner 23 which is composed of a soft and resilient material. The inner liner 23 is adapted to be placed in contact with the head of the user and to absorb shocks which are impacted through the outer shell 11. The helmet further includes an intermediate shell 24 which supports the plurality of electrical components 12. The inner liner 23 conforms to the corresponding shape of the inside diameter of the intermediate shell 24. It can also be seen that a substantial space is provided between the intermediate and outer shells so that the electronic components are occupied and accommodated therein. To this extent, a plurality of ribs, of which rib 25 is illustrated, fixedly separate the intermediate shell from the outer shell. For waterproofing purposes, foam or other cellular material may be disposed within the cavity 25 to protect the component from environmental attack.

It can be further seen in FIG. 3 that the outer shell 11 is attached to the intermediate shell 24 by means of a snap-lock arrangement illustrated in general by the numeral 26. It is the snap-lock arrangement which not only provides for adequate assembly but provides waterproof attachment therebetween.

Referring now in detail to FIG. 4, it can be seen that the inner liner 23 is a separate construction or piece from the intermediate shell 24 and the outer shell 11. Also, it can be seen that the intermediate shell 24 includes a platform 29 on which the electronic components 12 are mounted and which further incorporates the ribs 25, 26 and 27. The outer shell 11 includes a plurality of snap-fasteners 16 which readily accommodate mating fasteners carried on the visor 19 so that the visor may be readily taken off or installed onto the shell 11.

Referring now in detail to FIG. 5, it can be seen that the intermediate shell 24 is seperated from the outer shell 11 by the ribs 25, 26, and 27. These ribs also provide a cavity or chamber in which the electronic components 12 readily reside.

In FIG. 6, the snap-lock arrangement detachably connecting outer shell 11 to the intermediate shell 24 is illustrated. It can be seen that the means takes the form of a tongue-in-groove arrangement wherein a bead 30 integrally formed with the intermediate shell 24 is snap-locked into a receiving groove or recepticle 31 formed in the shell 11. Once the snap-lock arrangement has taken place, the two shells are coupled into a unitary construction. The snap-lock arrangement is waterproof and moisture cannot travel therearound. If desired, a resilient seal or a seal of O-ring nature 32 may be provided if necessary.

Referring now in detail to FIG. 7, it can be seen that the operating components for the electronic unit are waterproofed such as be means of a rubber-like seal 32 surrounding a typical on/off switch 33 which is exposed through an aperture in the outer shell 11. The body of the switch is illustrated as being within the chamber or space defined between the opposing surfaces of shell 11 and intermediate shell 24.

In view of the foregoing, it can be seen that the protective helmet of the present invention may be readily worn by a person engaging in a water sport so that the controls of the radio may be readily operated. The wearer of the helmet may enjoy listening to the radio programming. However, it is within the concept of the present invention to include other forms of electronic components such as a transmitter or if desired, a tape cassette unit may be incorporated therein. In any event, whatever electronic components are placed within the cavity between the opposing surfaces of the outer shell 11 and the intermediate shell 24, these components will be protected from moisture or engagement with water while the wearer is enjoying his water sport. If the wearer decides to dispense with the intermediate layer, he may readily use the inner layer 24 and the outer layer 11 respectively.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A protective waterproof helmet comprising:

a liner of soft, pliable material adapted to fit the head of the user;

an intermediate shell lying adjacent to and covering said liner;

an outer protective shell of hard material lying adjacent to and covering said intermediate shell;

detachable interlocking means carried along adjacent edge marginal regions of said outer shell and said intermediate shell adapted to join together to form a unitary construction so as to define a waterproof seal therebetween and to define a cavity between said outer shell surface depression and the opposing surface of said intermediate shell;

electronic components operably carried on said intermediate shell occupying said cavity between said outer and said intermediate shells;

strap means attached to said outer shell adapted to encircle the chin of the user to retain said unitary construction on the head of the user;

earphones for operable coupling to said electronic components and sealed in said strap means so as to be adjacent the ears of the user;

a rigid platform carried on said intermediate shell at the crown thereof for mounting said electronic components thereon;

a visor detachably carried on the front of said outer shell so as to extend outwardly therefrom between opposite ends of said strap means; and a sealing means carried on said outer shell immediately adjacent said interlocking means and engagable with said intermediate shell to effect a waterproof seal therewith.

2. The invention as defined in claim 1 wherein:

said interlocking means includes a tongue-in-groove snap-lock arrangement.

3. The invention as defined in claim 2 wherein:

said electronic components include a radio receiver for coupling to said earphones and a plurality of controls exposed through said outer shell for manual operation by the user.

4. The invention as defined in claim 3 including:

additional sealing means surrounding said exposed controls so as to prevent water from entering said cavity.

* * * * *